US005633651A

United States Patent [19]

Carvajal et al.

[11] Patent Number: 5,633,651

[45] Date of Patent: May 27, 1997

[54] AUTOMATIC BIDIRECTIONAL INDICATOR DRIVER

[75] Inventors: Fernando D. Carvajal, McKinney; Stephen C. Kwan, Plano, both of Tex.

[73] Assignee: Texas Instruments Incorporated, Dallas, Tex.

[21] Appl. No.: 334,501

[22] Filed: Nov. 4, 1994

[51] Int. Cl.[6] ..... G09G 3/32

[52] U.S. Cl. ..... 345/82; 345/46; 345/39; 340/815.45

[58] Field of Search ..... 345/82, 44, 46, 345/39; 250/200; 340/815.4, 815.45

[56] References Cited

U.S. PATENT DOCUMENTS

| | | | |
|---|---|---|---|
| 3,869,641 | 3/1975 | Goldberg | 340/815.45 |
| 4,083,042 | 4/1978 | Kushin et al. | 345/39 |
| 4,298,869 | 11/1981 | Okuno | 340/815.45 |
| 4,542,379 | 9/1985 | Satou | 345/46 |
| 4,743,897 | 5/1988 | Perez | 345/82 |
| 4,847,728 | 7/1989 | Youla | 340/815.45 |
| 4,952,915 | 8/1990 | Jenkins et al. | 340/815.45 |
| 5,138,310 | 8/1992 | Hirane et al. | 345/82 |

*Primary Examiner*—Richard Hjerpe
*Assistant Examiner*—Juliana S. Kim
*Attorney, Agent, or Firm*—Warren L. Franz; Mark E. Courtney; Richard L. Donaldson

[57] ABSTRACT

A bidirectional indicator driver circuit having automatic current sensing for driving an indicator regardless of its orientation. A comparator is coupled to memory which has an output indicating a driving direction polarity. An output driver which drives one terminal of a plurality of LED diodes is coupled to the memory. Individual three state buffers are coupled to the second terminal of each of the respective LEDs. The comparator detects whether the output driver is driving current. If no current is being driven to the LEDs, the comparator causes the memory to toggle states, and toggles the level of the polarity signal. Because the polarity signal is coupled to one terminal of the LEDs, the change in polarity will automatically cause one or more of the LEDs to be forward biased and emit light. The driver circuit can correctly operate LEDs which are incorrectly inserted into a circuit board or multichip module, because the direction the LEDs is driven will be changed until one or more devices is forward biased and current begins to flow. A second embodiment is described for an output driver circuit which will correctly operate LEDs regardless of their orientation using a clock and a common output driver. An integrated circuit incorporating the invention as output driver circuitry is described for use in a system where LEDs are used as indicators.

Other devices, systems and methods are also disclosed.

18 Claims, 2 Drawing Sheets

AUTOMATIC BIDIRECTIONAL INDICATOR DRIVER

FIELD OF THE INVENTION

This invention relates generally to integrated circuits and to printed circuit boards and light emitting indicator devices such as lamps and light emitting diodes (hereinafter LEDs), and specifically to driver circuitry for driving lamps and LEDs inserted into a printed circuit board or module.

BACKGROUND OF THE INVENTION

When designing integrated circuits and printed circuit boards where the circuitry is to drive at least one indicator lamp or LED as a display or indicator device, problems can arise when the printed circuit board has the LEDs inserted into it. Because the LED is a two terminal device, it can easily be placed into the board in the wrong orientation. This results in an indicator device which cannot be turned on. The possibility of this error being made is high, because the LED device is a simple device with a wire at each end, and it is difficult to tell from a quick visual inspection which end is which, that is the cathode and anode terminals appear the same. When automatic equipment is used, the LED devices may be loaded into an automated pick and place device incorrectly, so that although the machine places all of the LEDs in the same manner, the operator can still cause errors to occur.

The boards produced with the LEDs must be tested against the possibility that this placement error has occurred. Any boards which are produced with incorrectly placed LEDs must be reworked. This results in a lower initial yield and additional time and cost per unit, as these units must first be sent to a rework station and then subjected to a second round of testing before being qualified for shipment.

A need for a circuit and method which will eliminate rework for incorrectly placed LEDs in circuit boards thus exists.

SUMMARY OF THE INVENTION

Generally, and in one form of the invention, a circuit for driving LEDs is provided. The circuit includes current sensing circuitry, which detects whether power is flowing into an LED driver. The current sensing circuitry is coupled to a toggle circuit which outputs a polarity signal. If no current is flowing into an LED, the current sensing circuitry causes the toggle circuit to switch the polarity signal. This polarity signal is coupled to one terminal of one or more LEDs to be driven. When the polarity switches, an LED which is oriented in an incorrect direction will be placed in a forward biased condition and will operate correctly.

A second embodiment is provided which is a simpler approach that can be used in high speed environments. Both embodiments provide a circuit and method to eliminate the need for reworking boards where the LEDs are possibly placed incorrectly, as the circuits of the preferred embodiments automatically adjust for the incorrect placement. The result is a circuit that automatically correctly operates LEDs independent of their orientation.

An integrated circuit is provided which includes output buffers for driving LEDs using the circuitry of the invention and including user defined application logic circuitry. The integrated circuit can be used to drive LEDs regardless of their orientation, thus reducing rework and costs in a circuit board or module environment.

Additional embodiments for use in extending the time between LED or lamp replacements are described using the bidirectional LED driver of the invention.

BRIEF DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

Figure 1:
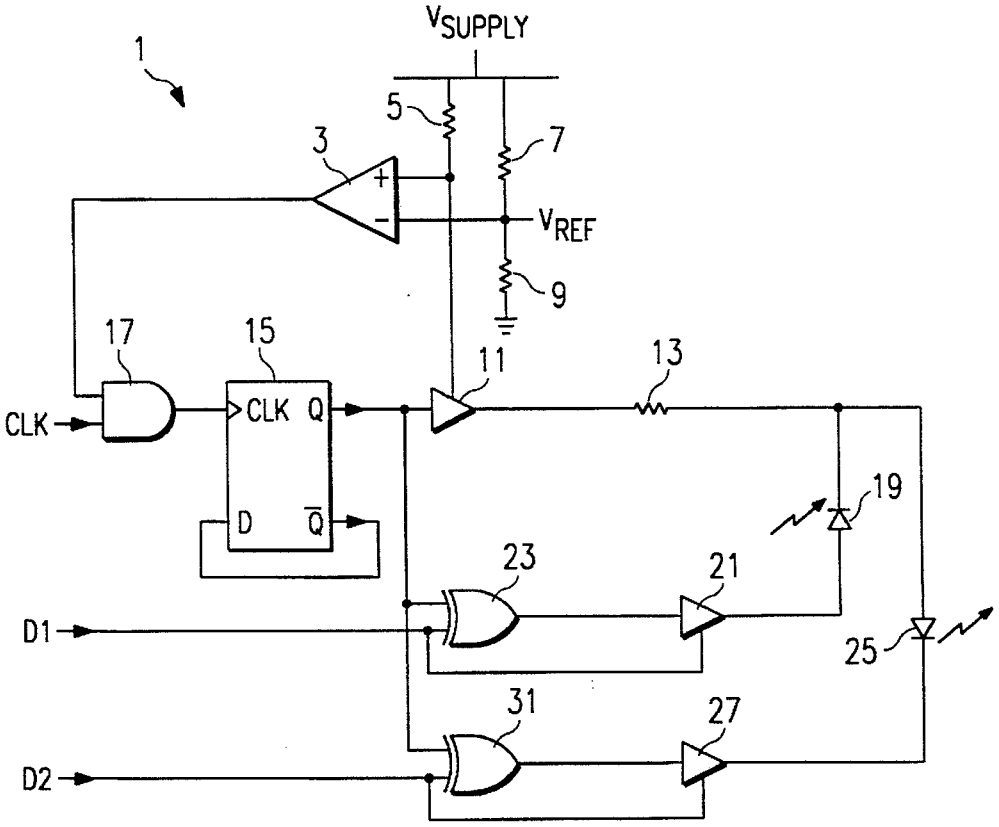
FIG. 1 depicts a first preferred embodiment of the LED driver circuit which incorporates the invention.

FIG. 1 depicts a circuit schematic for a first preferred embodiment of an LED driver circuit incorporating the invention. Comparator 3 is coupled to a resistors voltage divider comprised of resistor 7 and 9, which operate to provide a predetermined voltage reference at node Vref. Comparator 3 also receives the voltage at the output of resistor 5. AND gate 17 receives the output of comparator 3 and gates it with the clock input from the circuit input terminal labeled CLK. Register 15 is coupled to the output of AND gate 17, and has its data input D coupled to its inverted output Q. The Q output of register 15 forms a polarity signal. Driver 11 takes the polarity signal Q as an input and is coupled to either the cathode or anode of LEDs 19 and 25. LED 19 has its second terminal, either the cathode or anode, coupled to three state driver 21. Three state driver 21 has its enable input coupled to data input D1. The data input to three state driver 21 is coupled to the output of exclusive OR gate 23. Similarly, LED 25 has its second terminal, either cathode or anode, coupled to the output of three state driver 27, which has its three state enable signal coupled to data input signal D2. The data input to three state driver 27 is coupled to the output of exclusive OR gate 31.

In operation, first assume that the D2 data input is a low logic level, so that three state driver 27 is inactive. LED 25 will see a high impedance at one terminal, so regardless of the voltage at the second terminal, LED 25 will not be forward biased and will not emit light. Assume that data input D1 is a high logic value, which enables three state driver 21 to output the value coming out of exclusive OR gate 23 to one terminal of diode 19. Whether diode 19 will emit light now depends on the value of the Q output of register 15, since driver 11 is not a three state driver and will output whatever is placed at its input. Assume initially that the Q output of register 15 is a logic one, or high voltage. Exclusive OR gate 23 now sees a logic one on one input, and a logic one on the second input. So a logic zero is output at the output of exclusive OR gate 23. Also, the driver 11 sees a logic one at its input and therefore outputs a logic one. Thus LED 19 is reverse biased, and therefore no current can flow through diode 19.

The comparator 3 will detect a difference in two voltages: the reference voltage Vref set by the voltage divider consisting of resistors 7 and 9, and the voltage caused by the current flow through resistor 5 and into the driver 11. When driver 11 is not driving current, only minimal current flow occurs through resistor 5 and the voltage at the positive input to comparator 3 rises to the supply voltage. As a result, comparator 3 senses that no current is flowing into driver 11 and outputs a high voltage. When the next clock comes into AND gate 17, a logic one is output to the clock input of register 15. Register 15 is hooked up in a toggle mode, so when a clock edge occurs at the clock input, it will toggle the polarity signal Q. Now the driver 11 has a logic zero at its input, and will output a low voltage to one terminal of diode 19. Exclusive OR gate 23 will now see a logic zero voltage level at one input and a logic one at the other input, and will output a logic one to driver 21. Now diode 19 is forward biased and will emit light. Once current begins flowing through diode 19, the comparator circuit will start putting out a zero at its output, the Q output of register 15 will no longer change, and the LED 19 will continue to emit light.

The circuit of FIG. 1 works in exactly the same manner when the D2 signal is a logic one, and the D1 signal is a logic zero. When both inputs are a logic zero, then the comparator will toggle the Q polarity output of register 15 until current flows into at least one LED. This constant toggling condition is acceptable, because no LED is erroneously activated, and there are no other undesirable effects. Once either of the D1 and D2 signals changes state, current will begin to flow in the respective LED, 19 or 25, and the toggling of the Q polarity signal will stop.

The circuitry of FIG. 1 assumes that D1 and D2 are exclusive input signals, that is only one of them can be a logic one at a given time. If the two diodes are to be operated independently, another current sensing circuit including comparator 3 and resistors 5, 7 and 9, another AND gate 17, another toggling flip-flop 15 and a second driving buffer 11 and current limiting resistor 13 would be required for the second LED.

The importance of the circuit of FIG. 1 is that although the diodes 19 and 25 are shown in particular orientations, the orientations are purely arbitrary. Regardless of whether the diodes are oriented correctly or incorrectly, when the respective data line D1 or D2 is active, the LED which is enabled will become forward biased automatically and emit light. The use of the circuit of FIG. 1 therefore removes a number of potential errors from the board production process, and reduces the number of tests required, since it is not necessary to check for correct orientation of the LEDs in the board, and eliminates many rework operations that would be required in the prior art. Since the circuitry of FIG. 1 is inexpensive and easily produced, and since labor costs are increasing in the semiconductor industry, the elimination of expensive rework by use of the inexpensive circuit (FIG. 1) will lower the overall cost of produced boards and systems.

Figure 2:
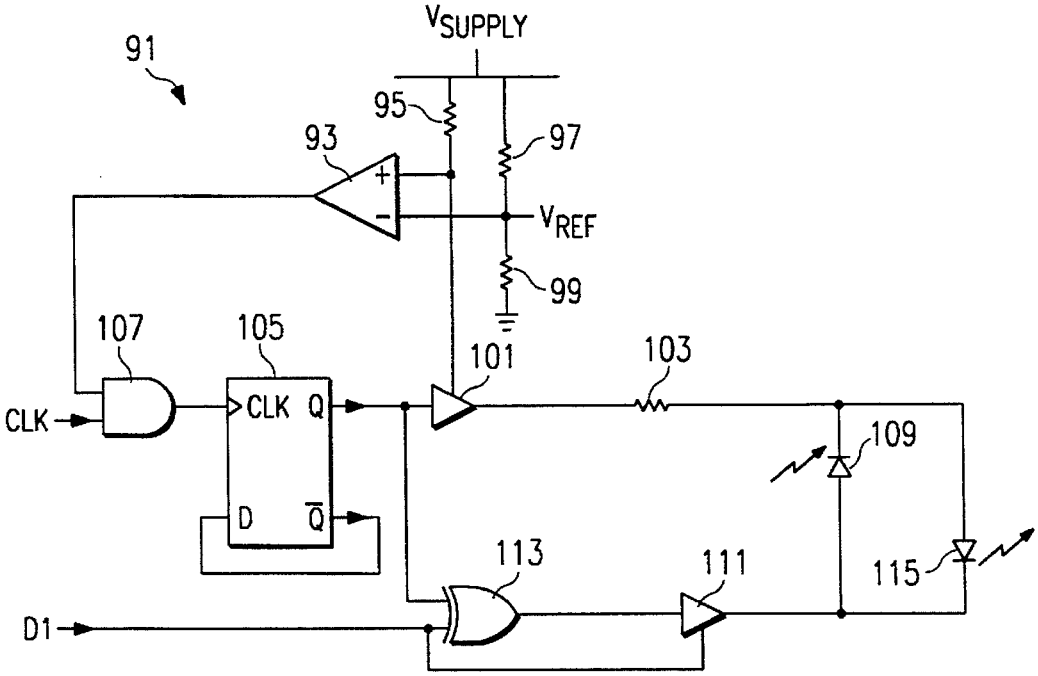
FIG. 2 depicts a second preferred embodiment of an LED driver for use in extending the time between LED replacements.

FIG. 2 depicts an alternative use of the current sensing circuitry and the register of FIG. 1. In FIG. 2, two diodes are hooked up to a single indicator location, LED 109 and 115. The diodes are oriented in opposite directions. Comparator 93 and resistors 95, 97 and 99 form a comparator which compares a reference voltage to the voltage developed in resistor 95 when current is flowing into driver 101, as before. AND gate 107 will cause a clock to be gated into register 105 when the comparator puts out a logic one, as before. Driver buffer 101 receives a supply current through resistor 95 and drives the polarity signal output at the Q output of register 105 into a common node through current limiting resistor 103, the common node being coupled to one terminal of both LED 109 and 115. Exclusive OR gate 113 receives the polarity signal output by register 105 and a data input D1, as before. The output of exclusive OR gate 113 is coupled to the input of tristate buffer 111, which has its enable coupled to the data input D1. The output of tristate buffer 111 is coupled to the second terminal of both LED 109 and 115.

In operation, the circuit of FIG. 2 will automatically drive one of the LEDs when the data signal D1 is a logic one, whichever LED is forward biased. Assume the LED devices 109 and 115 are oriented as shown. D1 is a logic one, so tristate buffer 111 is enabled. Initially, assume the register 105 has a one at its Q output; that is, the polarity signal is a one. The driver buffer 101 drives a logic one onto the first terminal of both LEDs 109 and 115. Exclusive OR gate 113 now has a one at both of its input terminals, and therefore outputs a logic zero. Diode 115 is forward biased, and will now emit light. Diode 109 is reverse biased, and will not emit light. Because the driver 101 is drawing current, comparator 93 will see a voltage of approximately equal potential at both of its inputs, and will therefore output a logic zero. As a result, the register 105 will not toggle and the operating condition is static.

Now assume that diode 115 burns out, having reached the end of its life. In prior art systems, the user would now be required to replace the LED. However, the use of the invention results in an automatic replacement taking place. When the current is not flowing into diode 115, which is no longer operating, the comparator 93 will sense a difference in potentials at its input terminal. As a result, it will output a logic one to AND gate 107, which will gate the incoming clock signal to register 105. The output of the register, the polarity signal, will now change from a logic one to a logic zero. Driver 101 will now pass a logic zero to the common terminal of LEDs 109 and 115. Exclusive OR gate 113 now sees a logic one at the D1 terminal and a logic zero at the other terminal, and outputs a logic one. LED 109 is now forward biased, and will light up. So the circuitry automatically replaces LED 115 with LED 109, and therefore eliminates the need to replace LED 115 when it fails. The time between LED replacements is now doubled, because the circuitry automatically inserts a working LED when the first one fails.

When the D1 input is a logic zero, the comparator 93 will sense that no current is flowing and will begin toggling register 105 until one of the LEDs again lights up in response to a high D1 input. This constant toggling has no ill effect and it is not necessary to compensate the circuit for it. Of course, at the time D1 goes high it is not known which of the two LEDs will be used, but that is also not important. Once one of them fails, the circuit will automatically reverse polarity until the other lights up.

The placement of the LEDs is no longer arbitrary. However, it is not necessary that the orientation of LEDs 109 and 115 be correct, so long as they are oriented in opposite directions.

Figure 3:
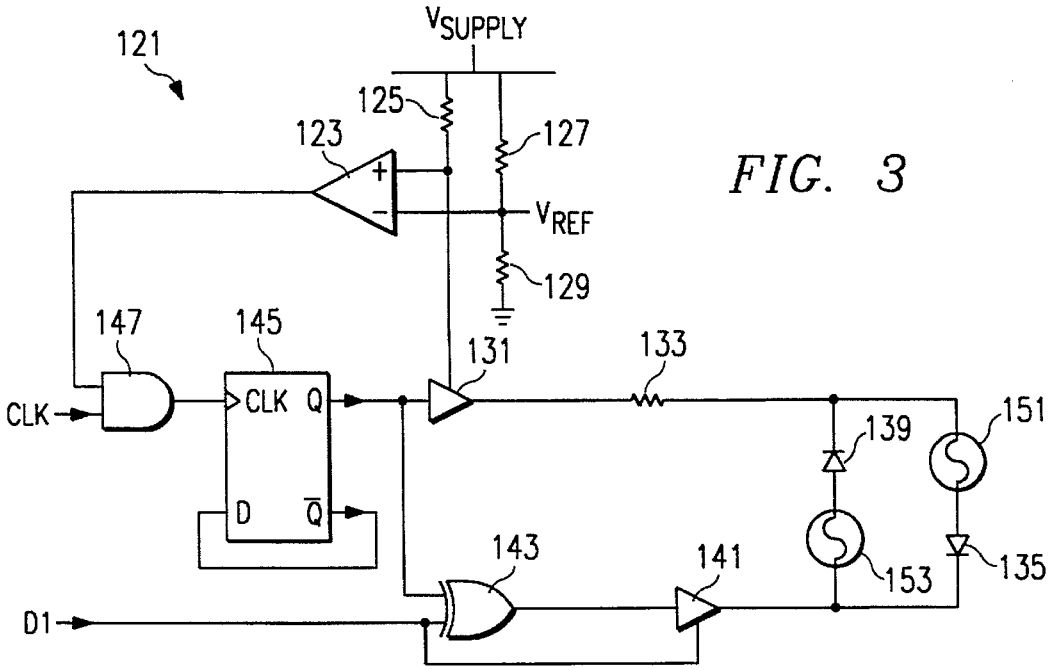
FIG. 3 depicts a third preferred embodiment of the driver of FIG. 1 in use in driving indicator lamps and extending the time between lamp replacements.

FIG. 3 depicts a third alternative for driving indicator lamp devices using an arrangement similar to that of FIG. 2. In FIG. 3, two lamps are hooked up to a single indicator location, lamps 153 and 151. The lamps are hooked up in series with diodes of opposite orientation, lamp 153 is in series with diode 139, and lamp 151 is in series with diode 135. The lamp diode pairs are hooked up in parallel and light a single indicator. Again, comparator 123 and resistors 127, 129 and 125 form a comparator which compares a reference voltage to the voltage developed in resistor 125 when current is flowing into driver 131, as before. AND gate 147 will cause a clock to be gated into register 145 when the comparator puts out a logic one, as before. Driver buffer 131 receives a supply current through resistor 125 and drives the polarity signal output at the Q output of register 145 into a common node through current limiting resistor 133, the common node being coupled to one terminal of both diode lamp pairs comprised of lamp 153 and diode 139, and lamp 151 and diode 135. Exclusive OR gate 143 receives the polarity signal output by register 145 and a data input D1, as before. The output of exclusive OR gate 143 is coupled to the input of tristate buffer 141, which has its enable coupled to the data input D1. The output of tristate buffer 141 is coupled to the second terminal of both lamp diode pairs.

In operation, the circuit of FIG. 3 will automatically drive one of the lamp diode pairs when the data signal D1 is a logic one, the lamp diode pair being whichever one has a diode that is forward biased. Assume the diodes 139 and 135 are oriented as shown. D1 is a logic one, so tristate buffer 131 is enabled. Initially, assume the register 145 has a one at its Q output, so the polarity signal is a one. The driver buffer 131 drives a logic one onto the first terminal of both diodes 139 and 135. Exclusive OR gate 143 now has a one at both of its input terminals, and therefore outputs a logic zero. Diode 135 is forward biased, and so lamp 151 will have current flowing through it and will now emit light. Diode 139 is reverse biased, and so lamp 153 will not have current flowing into it and will not emit light. Because the driver 131 is drawing current, comparator 123 will see a voltage of approximately equal potential at both of its inputs, and will therefore output a logic zero. As a result, the register 145 will not toggle and the operating condition is static.

Now assume that lamp 151 reaches the end of its life, and goes out. Current can no longer flow through lamp 151, and the driver 131 will not draw current through resistor 125. As a result, comparator 123 will see unequal potentials at its inputs and will output a logic one to AND gate 147. This AND gate will gate a clock signal into register 145 and will cause it to toggle. The polarity signal at the Q output of register 145 will now transition to a logic zero. Driver 131 will now output a logic zero to the common terminals of the lamp diode pairs. Exclusive OR gate 143 will see a logic zero at one terminal, and a logic one at the D1 input terminal, and will therefore output a logic one. The tristate buffer 141 will correspondingly output a logic one to the second terminals of the lamp diode pairs. Now diode 139 is forward biased. Current will flow through lamp 153 and it will light up. Again, the use of the invention results in a circuit that automatically replaces a lamp when it goes out with a good lamp, doubling the time between required lamp replacements. Again, when the D1 input is low, tristate buffer 141 is disabled and neither lamp will light up. Comparator 123 will then see a potential difference at its inputs and will output a logic one, causing the register 145 to constantly toggle. When the D1 input again becomes high, one of the lamp diode pairs will be forward biased and will light up. It is not known which lamp will light up, but whenever one burns out the circuitry will reverse the polarity until current flows, thereby using the remaining good lamp until it also fails.

Figure 4:
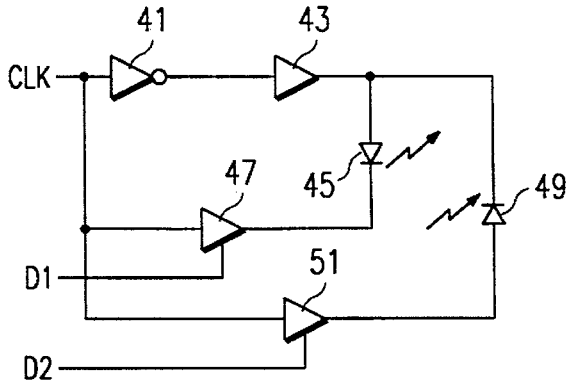
FIG. 4 depicts a fourth preferred embodiment of an LED driver.

FIG. 4 depicts a simpler circuit for driving LEDs in a circuit board regardless of whether they are properly placed. Clock signal input CLK is now coupled to an inverter 41 and a driver 43. The output of driver 43 is coupled to one terminal of LED diodes 45 and 47. Note that although diodes 45 and 47 are shown in a particular exemplary orientation, no orientation of cathode or anode to the output of driver 43 is presumed. To emphasize this, the two diodes are shown in opposite orientations. Data input D1 is coupled to the enable input of three state buffer 47. Diode 45 has its second terminal coupled to the output of three state buffer 47. Data input D2 is coupled to the enable input to three state buffer 51. Diode 49 has its second terminal coupled to the output of three state buffer 51. Both three state buffers, 47 and 51, are coupled to the CLK input.

In operation, first assume that the D2 input is a logic zero, so that the three state buffer 51 is disabled. Diode 49 will now have a high impedance value at one terminal, so that regardless of the value at the output of driver 43, the diode will not be forward biased and will not emit light. Now assume that data input D1 is a logic one. Three state buffer 47 is now enabled, and will pass the CLK input signal to one terminal of diode 45. Inverter 41 will cause the inverted CLK signal to pass through driver 43 and therefore to the other terminal of diode 45.

The operation of three state buffer 47 and inverter 41 and driver 43 will cause the two terminals of diode 45 to be at opposite potentials. Further, because the clock signal is constantly toggling, it can be seen that for half the duty cycle the diode 45 will be forward biased and will emit light. For the other half of the duty cycle of the CLK signal the diode 45 will be reversed biased and will not emit light. It can be shown that if the clock used in the system is faster than the human eye can detect, about 200 Hz, the diode 45 will appear to be on and constantly emitting light so long as the data signal D1 is a logic one. Since most systems now being built provide for a clock running at much higher frequencies, for most applications the clock can be used with the circuit of FIG. 4 and the diode will appear to be constantly on whenever D1 is a logic one.

Now suppose both D1 and D2 input signals in FIG. 4 are at a logic one. Both three state buffers 47 and 51 are now enabled, and the value at the clock input CLK will be transmitted to one terminal of each of the diodes 45 and 49. The inverted version of the clock signal CLK will be output by driver 43 to the other terminal of diodes 45 and 49. Note that as shown in FIG. 4, the diodes are oriented in opposite directions. This is purely arbitrary, but it is an interesting case. As a result of the opposite orientations of diodes 45 and 49, each will be emitting light, that is forward biased, when the other is reverse biased, and therefore dark. Each diode will emit light only half the time, since the CLK signal is constantly toggling. However, so long as the clock frequency exceeds 200 Hz, the diodes 45 and 49 will appear to be constantly on so long as both D1 and D2 input signals are a logic one, enabling the respective buffers to drive the diodes. When both D1 and D2 inputs are logic zero, neither three state buffer 47 or 51 will drive, and neither diode will become forward biased, therefore both will remain dark.

The circuit of FIG. 4 offers a simple solution to the problem of LED orientation in board production by providing correct operation of the LED regardless of the orientation of the devices. It should only be used in systems which are clocked at a frequency of greater than 200 Hz, however that includes most systems that exist or are being designed and so the embodiment of FIG. 4 can be used in most applications.

The circuit of FIG. 4 can be built up from off the shelf discrete devices, or included with other circuitry on an ASIC, gate array, programmable device, or custom integrated circuit. Transceiver devices using the circuits of FIGS. 1, 2, 3 and 4 are easily implemented to couple logic circuitry to the LEDs on a circuit board or multichip module.

Figure 5:
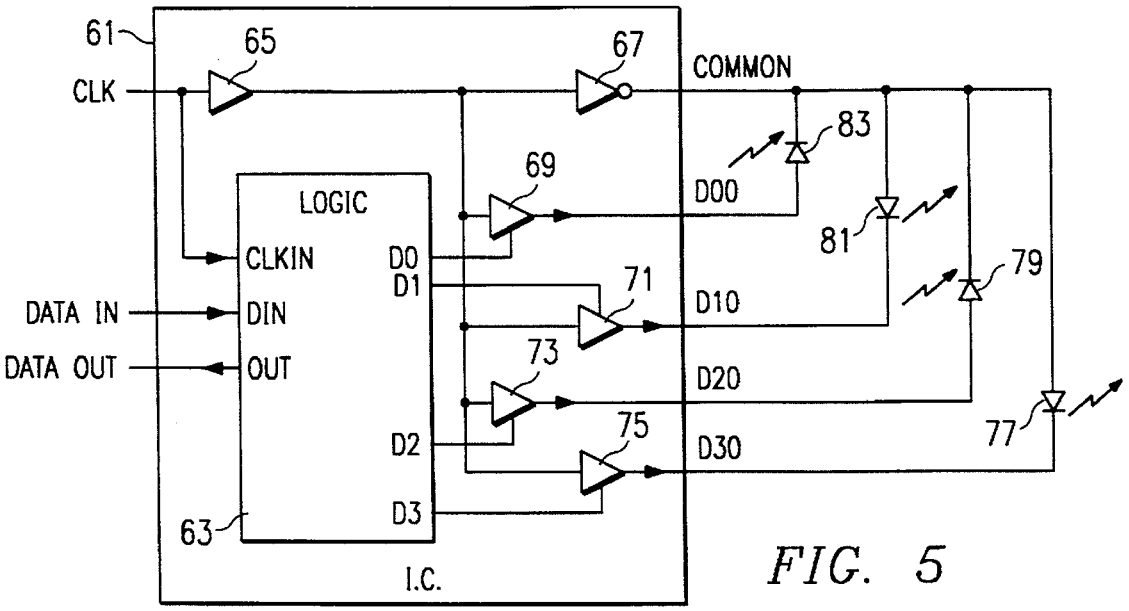
FIG. 5 depicts an integrated circuit including user defined application logic and a plurality of LED output drivers using the embodiment of FIG. 4.

FIG. 5 depicts an example integrated circuit which incorporates the circuit of FIG. 4 as output drivers. Integrated circuit 61 includes a clock input buffer 65 coupled to clock signal CLK, a user defined logic circuit 63 which receives the clock signal and a plurality of data signals DATA IN as inputs. The user defined circuitry 63 has a plurality of data outputs DATA OUT, and also has four indicator outputs D0–D3 which are to be used to drive LEDs. The buffered clock signal is coupled to an inverting output buffer 67 which drives the output COMMON. Three state buffers 69, 71, 73, and 75 each have their enable inputs coupled to the respective indicator outputs D0–D3. The data inputs to the three state buffer are tied together and to the buffered clock signal output by buffer 65. User defined circuitry 63 can be designed and developed using ROM, EPROM, gate array, ASIC, antifuse, fuse, programmable logic array, state machines, combinational logic, sequential logic or other well known design techniques. The user defined circuitry 63 can be simple or complex, and may include memory, ROM, or hard-coded data words. Other alternatives will be obvious to the practitioner skilled in the art.

In operation, the user defined circuitry 63 will perform any function required by the user. Examples are gauge controls, direct memory access controllers, personal computer start up circuits, process control functions, etc. Any arbitrary function may be included in the user defined circuitry. The indicator outputs will be high when the user defined circuitry needs to indicate a certain condition has occurred, or indicates a certain status, etc. The clock signal CLK is a constantly running signal of any frequency greater than 200 Hz. From the discussion above with respect to the operation of FIG. 4, it can be seen that the COMMON output is also a constantly toggling signal. Whenever one of the indicator output signals D0–D3 is a logic one, the associated three state buffer 69, 71, 73 or 75 will become enabled. Since the inputs to the three state buffers are a noninverted version of the clock signal, and the COMMON output is an inverted version of the clock signal, the LED 77, 79, 81 or 83 which is associated with the respective enabled three state buffer will become forward biased for half of the duty cycle of the CLK signal. Note that one, two or more of the LEDs may be enabled at a given time, and the respective LEDs will emit light so long as the associated indicator signal is active.

The preferred embodiments of FIGS. 1–5 are exemplary and are meant to describe the operation of the invention and do not limit the scope of the invention. Although the preferred embodiments of FIGS. 1–5 show illustrative use of particular circuit devices, many workable alternatives will be obvious to the skilled practitioner of the art. For example, the comparators are shown as op-amp type comparators. Other well-known comparator circuits may be used. The logic AND gate of FIGS. 1–3 may be replaced with any number of equivalent alternatives, as may the exclusive OR gates. These substitutions do not affect the operation of the circuit and still incorporate and attain the advantages of the invention, and are contemplated by this description and the claims herein. Other alternatives are also possible and are also contemplated by this description and the claims herein.

A few preferred embodiments have been described in detail hereinabove. This description is illustrative and is not to be construed in any limiting sense. It is to be understood that the scope of the invention also comprehends embodiments different from those described, yet within the scope of the claims. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A bidirectional indicator driver circuit, comprising:

a driving buffer coupled to a polarity signal and having a current supply input;

a plurality of indicator devices having two terminals, the first terminal of each of said indicator devices being coupled to said buffer;

current sensing circuitry coupled to a voltage supply and to said driving buffer, operable for sensing when said driving buffer is driving current to said indicator devices, and outputting a toggle signal when no current is being driven;

a polarity register having an input coupled to said toggle signal, and outputting said polarity signal, operable to invert said polarity signal in response to said toggle signal; and a plurality of tristate buffers coupled to a plurality of inputs, each being exclusively enabled responsive to a respective data input to transmit an inverted version of said polarity signal to the second terminal of a respective indicator device;

said bidirectional indicator driver circuit operable to drive said indicator devices independent of their orientation, said polarity register changing state in response to said toggle signal until one of said indicator devices is drawing current.

2. The indicator driving circuit of claim 1 wherein said indicator devices are light emitting diodes.

3. The indicator driving circuit of claim 1 wherein said current sensing circuitry further comprises:

a comparator circuit having an output that indicates when the potentials at a first and second input are unequal;

a resistor voltage divider coupled between a high supply voltage and a low supply voltage, operable for generating a reference voltage which is coupled to said first input of said comparator; and a resistor coupled between said high supply voltage and said driver buffer, developing a voltage at said second input of said comparator when current is flowing into said driver buffer.

4. The indicator driver circuit of claim 1, wherein said polarity register further comprises:

a logic AND gate coupled between said comparator circuit and a register clock input, said AND gate having a first input coupled to said toggle signal and a second input coupled to a clock signal, said AND gate transmitting said clock signal when said toggle signal is a logic one; and a data memory having its clock input coupled to said AND gate, and having its inverted output coupled to its data input signal, so that in response to said toggle signal and a transition in the clock signal, the output of said data memory changes to the opposite state.

5. An indicator driver circuit for automatically replacing failed indicator devices, comprising:

a driving buffer coupled to a current supply as a supply input and a polarity signal input, and transmitting said polarity signal to a first terminal of two indicator devices coupled in parallel;

current sensing circuitry coupled to said current supply to said driving buffer, operable for detecting when said driving buffer is supplying current to said indicator devices, said current sensing circuitry transmitting a toggle signal which indicates when no current is being supplied to either of said two indicator devices;

a polarity register coupled to said toggle signal from said current sensing circuitry and transmitting said polarity signal, said polity register changing state responsive to said toggle signal; and a tristate buffer coupled to a data input signal and to said polarity signal, operable to transmit an inverted version of said polarity signal to a second terminal of said two indicator devices responsive to said data input signal;

said indicator devices being oriented in opposite directions, so that when said data input signal enables the tristate buffer one of said indicator devices will be forward biased and emit light, and if that indicator device fails to conduct current the current sensing circuitry will transmit said toggle signal to said polarity register and cause said polarity signal to change state, the other one of said indicator devices then becoming forward biased and emitting light.

6. The driver circuit of claim 5, wherein said indicator devices each comprise an LED, said two LEDs being oriented in opposite directions so that for a first state of said polarity signal one of the LEDs is forward biased, and for a second state of said polarity signal the other LED is forward biased.

7. The driver circuit of claim 5, wherein said indicator devices each comprise:

a lamp having a first and second terminal; and a diode having a first and second terminal and coupled in series with said lamp;

the two indicator devices therefore each having first and second terminals, and the two indicator devices being coupled in opposite orientations such that when one of the diodes is forward biased, the other is reverse biased.

8. The driver circuit of claim 5 wherein said current sensing circuitry comprises:

a comparator having an output which indicates when unequal potentials are applied at its two input terminals;

a first and second resistor coupled as a resistive voltage divider, and transmitting a reference voltage that is coupled to one of the inputs of said comparator; and a third resistor coupled between the high supply voltage and said current supply of said driver buffer, and outputting a voltage that is equal to said reference voltage when said driver buffer is supplying current to said indicator devices.

9. A method of driving indicator devices irrespective of their orientation, comprising the steps of:

providing a driving buffer coupled to a polarity signal and having a current supply input;

providing a plurality of indicator devices having two terminals, a first terminal of each of said indicator devices being coupled to said buffer;

providing current sensing circuitry coupled to a voltage supply and to said driving buffer, operable for sensing when said driving buffer is driving current to said indicator devices, and outputting a toggle signal when no current is being driven;

providing a polarity register having an input coupled to said toggle signal, and outputting said polarity signal, operable to invert said polarity signal in response to said toggle signal;

providing a plurality of tristate buffers coupled to a plurality of inputs, each being exclusively enabled responsive to a respective data input to transmit an inverted version of said polarity signal to a second terminal of a respective indicator device; and operating said driving buffer, said tristate buffers, said current sensing circuitry and said polarity register such that said polarity register changes state in response to said toggle signal until one of said indicator devices is drawing current responsive to a respective data input, said indicator device thus emitting light irrespective of its orientation.

10. The method of claim 9 wherein said step of providing indicator devices comprises the step of providing light emitting diodes.

11. The method of claim 9 wherein said step of providing current sensing circuitry further comprises the steps of:

providing a comparator circuit having an output that indicates when the potentials at a first and second input are unequal;

providing a resistor voltage divider coupled between a high supply voltage and a low supply voltage, operable for generating a reference voltage which is coupled to said first input of said comparator;

providing a resistor coupled between said high supply voltage and said driver buffer, developing a voltage at said second input of said comparator when current is flowing into said driver buffer; and operating said comparator circuit such that it transmits a toggle signal when no current is being supplied to said driver buffer, indicating that no indicator device is operating and emitting light.

12. The method of claim 9, wherein said step of providing a polarity register further comprises:

providing a logic AND gate coupled between said comparator circuit and a register clock input, said AND gate having a first input coupled to said toggle signal and a second input coupled to a clock signal, said AND gate transmitting said clock signal when said toggle signal is a logic one; and providing a clocked data memory having its clock input coupled to said AND gate, and having its inverted output coupled to its data input signal, so that in response to said toggle signal and a transition in the clock signal, the output of said data memory changes to the opposite state.

13. A method for automatically replacing failed indicator devices, comprising:

providing a driving buffer coupled to a current supply as a supply input and having a polarity signal input, said driving buffer transmitting said polarity signal to a first terminal of first and second indicator devices coupled in parallel;

providing current sensing circuitry coupled to said driving buffer, operable for detecting when said driving buffer is supplying current to said indicator devices, said current sensing circuitry transmitting a toggle signal indicating when no current is being supplied to either of said first and second indicator devices;

providing a polarity register coupled to said toggle signal from said current sensing circuitry and transmitting said polarity signal, said polarity register changing state responsive to said toggle signal;

providing a tristate buffer coupled to a data input signal and to said polarity signal, operable to transmit an inverted version of said polarity signal to a second terminal of each of said first and second indicator devices responsive to said data input signal; and placing said indicator devices such that they are oriented in opposite directions, so that when said data input signal enables the tristate buffer a selected one of said indicator devices will be forward biased and emit light, and if that selected indicator device fails to conduct current the current sensing circuitry will transmit said toggle signal to said polarity register and cause said polarity signal to change state, the other one of said indicator devices then becoming forward biased and emitting light.

14. The method of claim 13, wherein said step of providing indicator devices further comprises the steps of:

providing first and second LEDs, the first and second LEDs being oriented in opposite directions so that for a first state of said polarity signal one of the LEDs is forward biased, and for a second state of said polarity signal the other LED is forward biased, the first and second LEDs being enabled responsive to said data input signal.

15. The method of claim 13 wherein said step of providing indicator devices further comprises the steps of:

for each indicator device, providing a lamp having a first and second terminal;

for each indicator device, providing a diode having a first and second terminal and coupled in series with said lamp;

the first and second indicator devices therefore each having first and second terminals; and placing the first and second indicator devices so that they are coupled in opposite orientations, such that when one of the diodes is forward biased, the other is reverse biased.

16. The method of claim 13 wherein said step of providing current sensing circuitry further comprises the steps of:

providing a comparator which transmits an output signal indicating when unequal potentials are applied at two input terminals of the comparator;

providing a resistive voltage divider, operable for transmitting a reference voltage that is coupled to one of the inputs of said comparator; and providing a resistor coupled between a high supply voltage and said current supply of said driver buffer, the resistor outputting a voltage that is equal to said reference voltage when said driver buffer is supplying current to said indicator devices.

17. A bidirectional indicator driver circuit, comprising:

a driving buffer coupled to a polarity signal and having a current supply input;

an indicator device including a diode having anode and cathode terminals, one of said anode and cathode terminals being coupled to said driving buffer;

current sensing circuitry coupled to a voltage supply and to said driving buffer, operable for sensing when said driving buffer is driving current to said indicator device, and outputting a toggle signal when no current is being driven;

a polarity register having an input coupled to said toggle signal, and outputting said polarity signal, operable to invert said polarity signal in response to said toggle signal; and a tristate buffer coupled to an input, said buffer being exclusively enabled responsive to a data input to transmit an inverted version of said polarity signal to the other of said anode and cathode terminals of said indicator device;

said bidirectional indicator driver circuit operable to drive said indicator device independent of which of said anode and cathode terminals is said one terminal and which is said other terminal, said polarity register changing state in response to said toggle signal until said indicator device is drawing current.

18. A method of driving an indicator device independent of its orientation, comprising the steps of:

providing a driving buffer coupled to a polarity signal and having a current supply input;

providing an indicator device including a diode having anode and cathode terminals, one of said anode and cathode terminals being coupled to said driving buffer;

providing current sensing circuitry coupled to a voltage supply and to said driving buffer, operable for sensing when said driving buffer is driving current to said indicator device, and outputting a toggle signal when no current is being driven;

providing a polarity register having an input coupled to said toggle signal, and outputting said polarity signal, operable to invert said polarity signal in response to said toggle signal;

providing a tristate buffer coupled to an input, said buffer being exclusively enabled responsive to a data input to transmit an inverted version of said polarity signal to the other of said anode and cathode terminals of said indicator device; and operating said driving buffer, said tristate buffer, said current sensing circuitry and said polarity register such that said polarity register changes state in response to said toggle signal until said indicator device is drawing current, to drive said indicator device independent of which of said anode and cathode terminals is said one terminal and which is said other terminal.

* * * * *